US005306587A

United States Patent [19]

Terrell et al.

[11] Patent Number: 5,306,587

[45] Date of Patent: Apr. 26, 1994

[54] PHOTOSENSITIVE RECORDING MATERIAL

[75] Inventors: David R. Terrell, Lint; Frans C. De Schryver, Linden; Carina Geelen, Louvain; Marcel J. Monbaliu, Mortsel; Stefaan K. De Meutter, Antwerp; Mark G. Van der Auweraer; Guy P. Verbeek, both of Louvain, all of Belgium

[73] Assignee: Agfa-Gevaert, N.V., Mortsel, Belgium

[21] Appl. No.: 935,299

[22] Filed: Aug. 26, 1992

[30] Foreign Application Priority Data

Sep. 24, 1991 [EP] European Pat. Off. ..... 91202469

[51] Int. Cl.[5] ..... G03G 5/06

[52] U.S. Cl. ..... 430/58; 430/56; 430/72; 430/73; 430/75; 430/78

[58] Field of Search ..... 430/58, 56, 72, 73, 430/75, 78

[56] References Cited

U.S. PATENT DOCUMENTS

| | | | |
|---|---|---|---|
| 3,871,883 | 3/1975 | Hashimoto | 430/83 |
| 4,135,928 | 1/1979 | Hashimoto et al. | 430/78 |
| 5,061,796 | 10/1991 | Hioki et al. | 430/72 |

FOREIGN PATENT DOCUMENTS

| | | |
|---|---|---|
| 2747144 | 5/1978 | Fed. Rep. of Germany . |
| 2-136861 | 5/1990 | Japan . |
| 4-242259 | 8/1992 | Japan . |

*Primary Examiner*—Christopher Rodee
*Attorney, Agent, or Firm*—Breiner & Breiner

[57] ABSTRACT

A photosensitive recording material which comprises an electrically conductive support having thereon a layer containing a charge transporting compound (n-CTM-compound) capable of accepting and transporting electrons obtained by radiation-activated charge-generation in a charge generating compound (CGM-compound) present in said material, wherein said n-CTM-compound corresponds to a general formula (A), (B), or (C) as defined in the description.

(A)

(B)

(C)

12 Claims, 3 Drawing Sheets

PHOTOSENSITIVE RECORDING MATERIAL

DESCRIPTION

1. Field of the invention

The present invention relates to photosensitive recording materials suitable for use in electrophotography.

2. Background of the invention

In electrophotography photoconductive compounds are used to form a latent electrostatic charge image on the surface of a recording material containing such compounds. The latent electrostatic charge image is made visible with a finely divided colouring material, called toner, is transferred to a suitable substrate and is fixed by heat, pressure and/or solvent to said substrate.

The formation of said latent image can proceed by the use in said recording material of so-called charge generating material (CGM) and charge transporting material (CTM) and by a process comprising the following steps:

- surface charging of the earthed photoconductive recording material with either positive or negative charge depending on the composition of the photoconductive recording material;
- imagewise exposure of the photoconductive recording material wherein electron-hole pairs are produced in the charge generating material (CGM) upon absorption of incident light;
- transfer of charge from the imagewise-produced charge carriers (electrons or positive holes) to the charge transporting material (CTM);
- transport of the electrons or holes produced by this process to the surface of the photoconductive recording material under the influence of the electric field applied over said material whereupon discharge of the surface charge takes place.

The photosensitive recording material may incorporate the charge generating material and charge transporting material in separate contacting layers or in a single layer.

To obtain the chargeability required to obtain an adequately tonered image the photoconductive layer or layers must have a certain minimum overall thickness, usually at least 10 micron.

It has been found experimentally that, in general, a higher photosensitivity is obtained if most of the overall thickness is occupied by one or more CTM's. In such configurations the layer in which charge generation or combined charge generation and charge transport take place and which largely determines the photosensitivity of the photosensitive recording material is fairly thin, with a thickness between 0.3 and 5 microns. Abrasion of this layer would immediately lead to a significant reduction in photosensitivity, which is undesirable.

High sensitivity photoconductive recording materials have therefore, in general, the layer whose sole function is charge transport as an outermost layer and a fairly thin charge generation material layer or layer of combined charge generation-charge transport material between the charge transporting layer and a conductive base serving as contacting electrode. In such configurations the sign of the electrostatic chargeability of the photosensitive recording material will depend upon whether the CTM or CTM's in the charge transporting layer preferentially transport electrons or positive holes. In the case of hole-transport the photosensitive recording material will be negatively chargeable and in the case of electron transport the photosensitive recording material will be positively chargeable.

Patent literature in the field frequently deals with hole-transporting CTM's, but little literature is available concerning electron-transporting CTM's. The scarcity of efficient electron-transporting CTM's is underlined by the predominance of negatively chargeable organic photoconductors (OPC's) in the commercially available photoconductive recording systems.

There are, however, applications in which it is more desirable to charge the photosensitive recording material positively rather than negatively, e.g. because of the availability of a better positively chargeable or negatively chargeable toner, depending on whether toner development proceeds in a negative-positive process or positive-positive (reversal) process.

A search has revealed that only a small number of efficient and practically useful electron transporting materials, called n-CTM's, are available because of the following problems:

- insufficient solubility in binders and coating solvents
- toxicity
- fatigue effects
- intrinsic colour One of the most efficient n-CTM's is 2,4,7-trinitrofluorenone (TNF) disclosed in U.S. Pat. No. 3,484,237. However, TNF is carcinogenic and has an intensive yellow colour, which disqualifies it from applications with a light source from the short wavelength end of the visible spectrum.

In U.S. Pat. No. 4,869,985 n-CTM compounds within the scope of the following general formula have been disclosed:

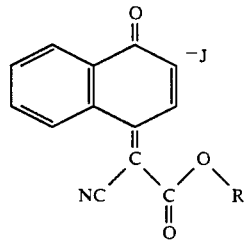

wherein

J is alkyl having 1 to 6 carbon atoms, and

R is normal alkyl having 1 to 6 carbon atoms.

In lastmentioned U.S. patent it is stated that these compounds exhibit good solubility or dispersibility in many coating solvents and in many polymeric film-forming binders.

They have a good capability of accepting and transporting electrons generated by radiation-activated charge-generation materials (CGM's), and they do not impart unacceptably high dark decay properties to electrophotographic recording elements.

As can be derived from said U.S. patent document and particularly from the prior art discussed therein it is rather difficult to find electron-transporting compounds (n-CTM's) with adequate solubility in casting solvents and binders.

Further an efficient electron transporting compound in a photosensitive recording material must exhibit:

- a reduction potential which enables efficient electron transfer to take place between the CGM and the n-CTM;

chemical stability;

acceptable electro-optical stability in electro-optical cycling; and efficient electron transport.

SUMMARY OF THE INVENTION

It is an object of the present invention to provide novel electron-transporting compounds called n-CTM's for use in photosensitive recording materials having:

(1) excellent solubility in casting solvents such as methylene chloride;

(2) excellent solubility in binders such as polycarbonate and polystyrene in the absence of p-CTM's, and (3) little visible light absorption.

It is a further object to provide photosensitive recording materials incorporating said CTM's characterized by high photo-sensitivity, high charging level and low fatigue, i.e. charging level and residual potential stability in cyclic use.

Other objects and advantages of the present invention will appear from the further description and examples.

In accordance with the present invention a photosensitive recording material is provided which comprises an electrically conductive support having thereon a layer containing a charge transporting compound (n-CTM-compound) capable of accepting and transporting electrons which have been obtained by radiation-activated charge-generation from a charge generating compound (CGM-compound) present in said material, characterized in that said n-CTM-compound corresponds to the following general formula (A):

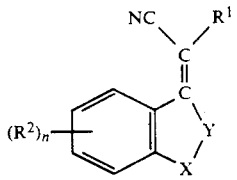

(A)

wherein:

$R^1$ represents CN, $COOR^3$ or $COR^3$, $R^2$ represents CN, $NO_2$, $COOR^3$, $COR^3$, $SO_2R^4$, F, Cl, alkyl including a substituted alkyl group or an alkoxy group, $R^3$ represents an alkyl group, an aryl group or an aralkyl group including said groups in substituted form, $R^4$ represents F, Cl, an alkyl, an aryl or an aralkyl group including said groups in substituted form;

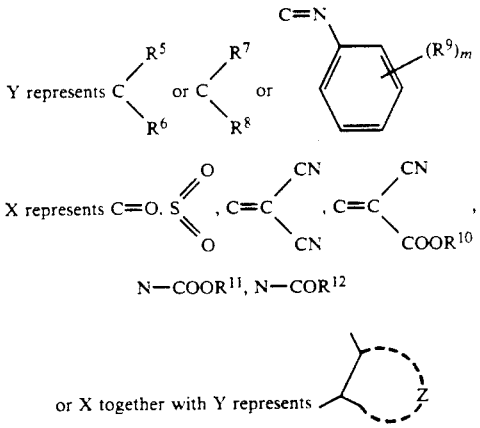

-continued

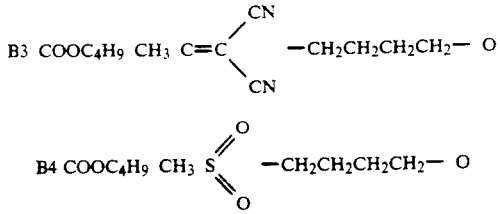

Z represents the atoms and bonds necessary to form a heterocyclic ring structure including said structure in substituted form;

$R^5$ represents an alkyl group including said group in substituted form, $R^6$ represents an alkyl, an alkenyl group. e.g. allyl group, an aryl group, e.g. a phjenyl group, a $—CONR^7R^8$ group or a heterocyclic group including said groups in substituted form, each of $R^7$ and $R^8$ (same or different) represents an alkyl or an aryl group including said groups in substituted form or together represent the atoms and bonds necessary to form a carbocyclic or a heterocyclic ring structure including said structure in substituted form;

$R^9$ represents an alkyl group including a substituted alkyl group, an alkoxy group, F, Cl, CN, $NO_2$, a $NR^{13}R^{14}$ group, wherein each of $R^{13}$ and $R^{14}$ represents a $COR^{17}$ or $COOR^{\sim}$ group, $R^{17}$ and $R^{18}$ having the definition given below, or $R^9$ represents a $COOR^{15}$ or $COR^{16}$ group, wherein $R^{15}$ and $R^{16}$ have the definition given below;

each of $R^{10}$, $R^{11}$, $R^{12}$, $R^{15}$, $R^{16}$, $R^{17}$ and $R^{18}$ (same or different) represents an alkyl group, an aryl group or an aralkyl group including said groups in substituted form, n is 0, 1 or 2, and m is 0, 1 or 2.

Other compounds suitable for use according to the present invention and within the scope of said general formula (A) are so called "duplo-compounds" corresponding to the following general formulae (B) or (C)

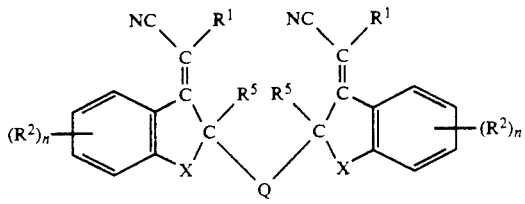

(B)

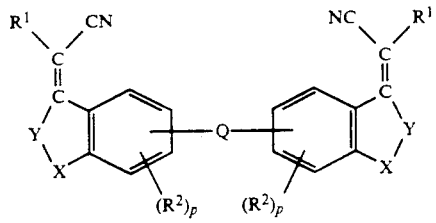

(C)

wherein:

Q represents a divalent organic group, e.g. an alkylene group, C=0, $C(CN)_2$ or $—CH_2—Ar—CH_2—$ group, wherein Ar is an arylene group, $R^1$, $R^2$, $R^5$, X, Y and n are as defined above, and P is zero or 1.

DETAILED DESCRIPTION OF THE INVENTION

Particularly suitable compounds for use according to the present invention are listed in the following Tables I and II with their structural formulae, melting points, solubility in $CH_2Cl_2$ and half-wave reduction potentials:

TABLE I (A)

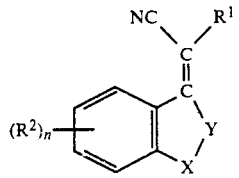

| No. | $R_1$ | Y | X | $R_2$ | n | melting point [°C.] | $E_{red}^{\frac{1}{2}}$ [V] | solubility in $CH_2Cl_2$ g/100 ml |
|---|---|---|---|---|---|---|---|---|
| A1 | CN | $C(CH_3)_2$ | $C(CN)=C(CN)$ | — | 0 | 229 | −0.593 | 20 |
| A2 | CN | $C(CH_3)(C_2H_5)$ | $C(CN)=C(CN)$ | — | 0 | 213 | −0.605 | 15 |
| A3 | CN | $C(CH_3)(C_4H_9)$ | $C(CN)=C(CN)$ | — | 0 | 177 | −0.611 | >10 |
| A4 | CN | $C(CH_3)(C_6H_{13})$ | $C(CN)=C(CN)$ | — | 0 | 159 | −0.611 | >25 |
| A5 | CN | $C(CH_3)(phenyl)$ | $C(CN)=C(CN)$ | — | 0 | >260 | −0.606 | 13 |
| A6 | $COOC_2H_5$ | $C(CH_3)_2$ | $C(CN)=C(CN)$ | — | 0 | 140 | −0.730 | 40 to 45 |
| A7 | CN | $C(CH_3)_2$ | C=O | — | 0 | 179 | −0.880 | 16 to 20 |
| A8 | CN | $C(C_2H_5)(C_3H_7)$ | C=O | — | 0 | 69 | −0.938 | |
| A9 | CN | $C(C_2H_5)_2$ | C=O | — | 0 | 121 | −0.941 | >10 |
| A10 | CN | $C(C_2H_5)_2$ | $C(CN)=C(CN)$ | — | 0 | 258 | | |
| A11 | CN | C=N(phenyl) | $C(CN)=C(CN)$ | — | 0 | 225 | −0.228 | 16 to 20 |

TABLE I-continued
(A)
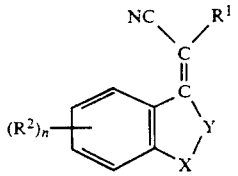
| No. | $R_1$ | Y | X | $R_2$ | n | melting point [°C.] | $E_{red}^{\frac{1}{2}}$ [V] | solubility in $CH_2Cl_2$ g/100 ml |
|---|---|---|---|---|---|---|---|---|
| A12 | CN | 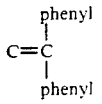 | C=O | — | 0 | | | |
| A13 | CN | 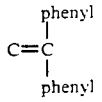 | 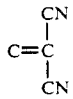 | — | 0 | | | |
| A14 | CN | 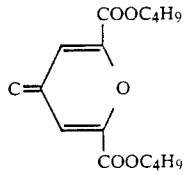 | 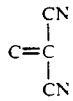 | — | 0 | | | |
| A15 | CN | 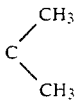 | 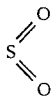 | — | 0 | 181 | | 10 |
| A16 | CN | 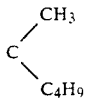 | 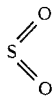 | — | 0 | | | |
| A17 | CN | 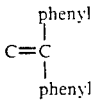 | 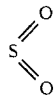 | — | 0 | | | |
| A18 | CN | 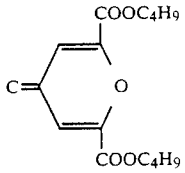 | 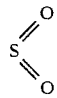 | — | 0 | | | |
| A19 | $COOC_4H_9$ | 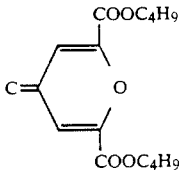 | 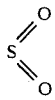 | — | 0 | | | |
| A20 | $COOC_4H_9$ | 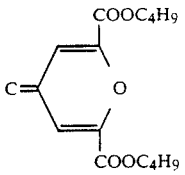 | 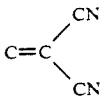 | — | 0 | | | |

TABLE I-continued
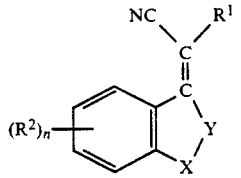
(A)
| No. | $R_1$ | Y | X | $R_2$ | n | melting point [°C.] | $E_{red}^{\frac{1}{2}}$ [V] | solubility in $CH_2Cl_2$ g/100 ml |
|---|---|---|---|---|---|---|---|---|
| A21 | CN | 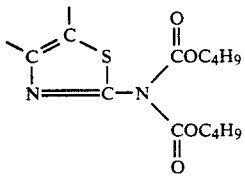 | | — | 0 | 130 | −0.488 | >25 |
| A22 | CN | 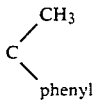 | C=O | — | 0 | 125 | −0.781 | 33 |
| A23 | $COOC_2H_5$ | 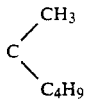 | 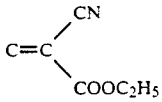 | — | 0 | 77 | −0.917 | |
| A24 | CN | 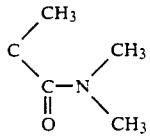 | 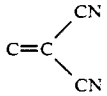 | — | 0 | >260 | −0.546 | 4 |
| A25 | CN | 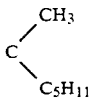 | 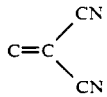 | — | 0 | 168 | −0.610 | 60 |
| A26 | CN | 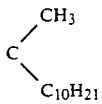 | 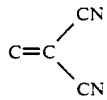 | — | 0 | 97 | −0.603 | >50 |
| A27 | CN | 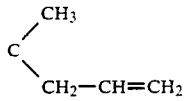 | 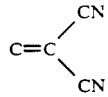 | — | 0 | 166 | −0.598 | 50 |
| A28 | CN | 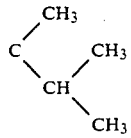 | 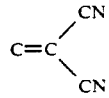 | — | 0 | 252 | −0.635 | 6 |
| A29 | CN | 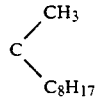 | 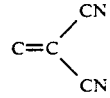 | — | 0 | 100 | −0.598 | 100 |
| A30 | CN | 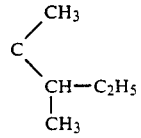 | 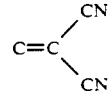 | — | 0 | 214 | −0.635 | 6 |

TABLE I-continued
(A)
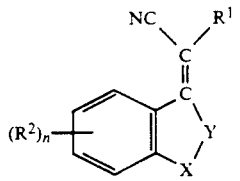
| No. | $R_1$ | Y | X | $R_2$ | n | melting point [°C.] | $E_{red}^{\frac{1}{2}}$ [V] | solubility in $CH_2Cl_2$ g/100 ml |
|---|---|---|---|---|---|---|---|---|
| A31 | CN | 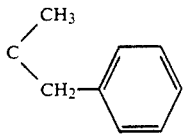 | 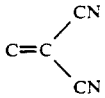 | — | 0 | 244 | −0.572 | 28 |
| A32 | CN | 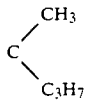 | 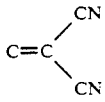 | — | 0 | 211 | −0.603 | 22 |
| A33 | CN | 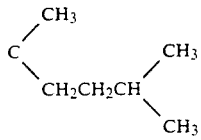 | 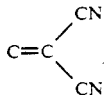 | — | 0 | 192 | −0.584 | 33 |
| A34 | CN | 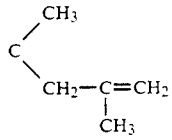 | 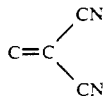 | — | 0 | 175 | | 50 |
| A35 | CN | 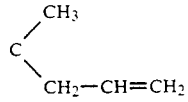 | 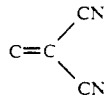 | m-$CH_3$ | 1 | 163 | | 70 |
TABLE II
(B)
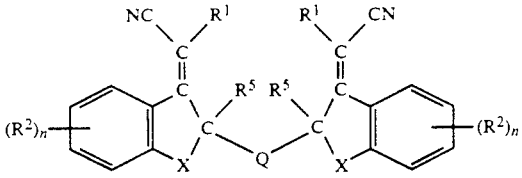
| No. | $R^1$ | $R^5$ | X | Q | $R^2$ | n |
|---|---|---|---|---|---|---|
| B1 | CN | $CH_3$ | 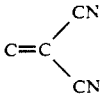 | $-CH_2CH_2CH_2CH_2-$ | — | 0 |
| B2 | CN | $CH_3$ | 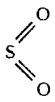 | $-CH_2CH_2CH_2CH_2-$ | — | 0 |
| B3 | $COOC_4H_9$ | $CH_3$ | 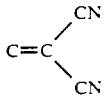 | $-CH_2CH_2CH_2CH_2-$ | — | 0 |

TABLE II-continued

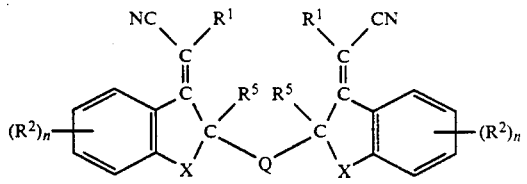

(B)

| No. | $R^1$ | $R^5$ | X | Q | $R^2$ | n |
|---|---|---|---|---|---|---|
| B4 | $COOC_4H_9$ | $CH_3$ | $SO_2$ | $-CH_2CH_2CH_2CH_2-$ | — | 0 |

Figure 1:
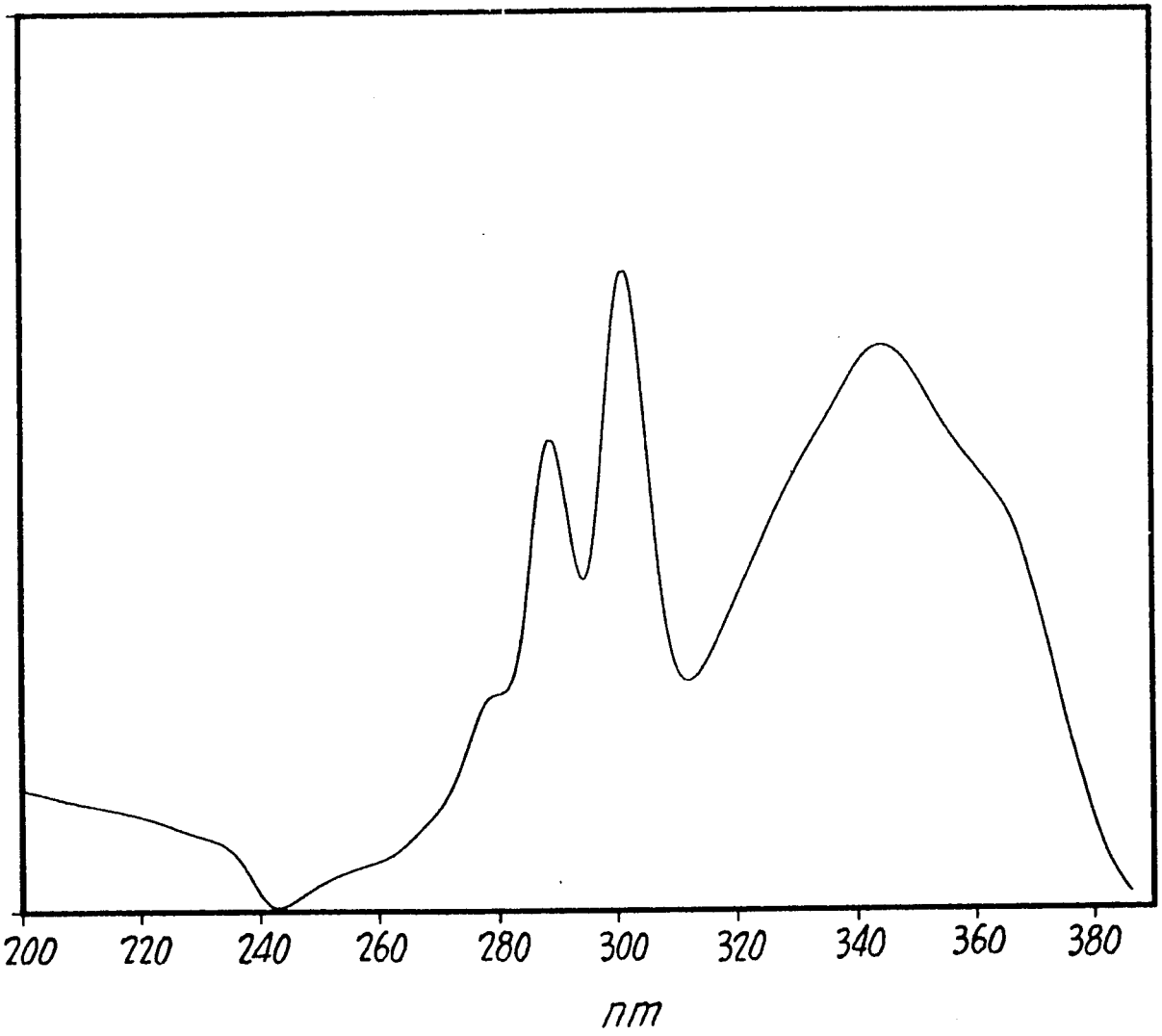
FIG. 1 is an absorption spectra for charged transport compounds A1 from page 6, supra.
Figure 2:
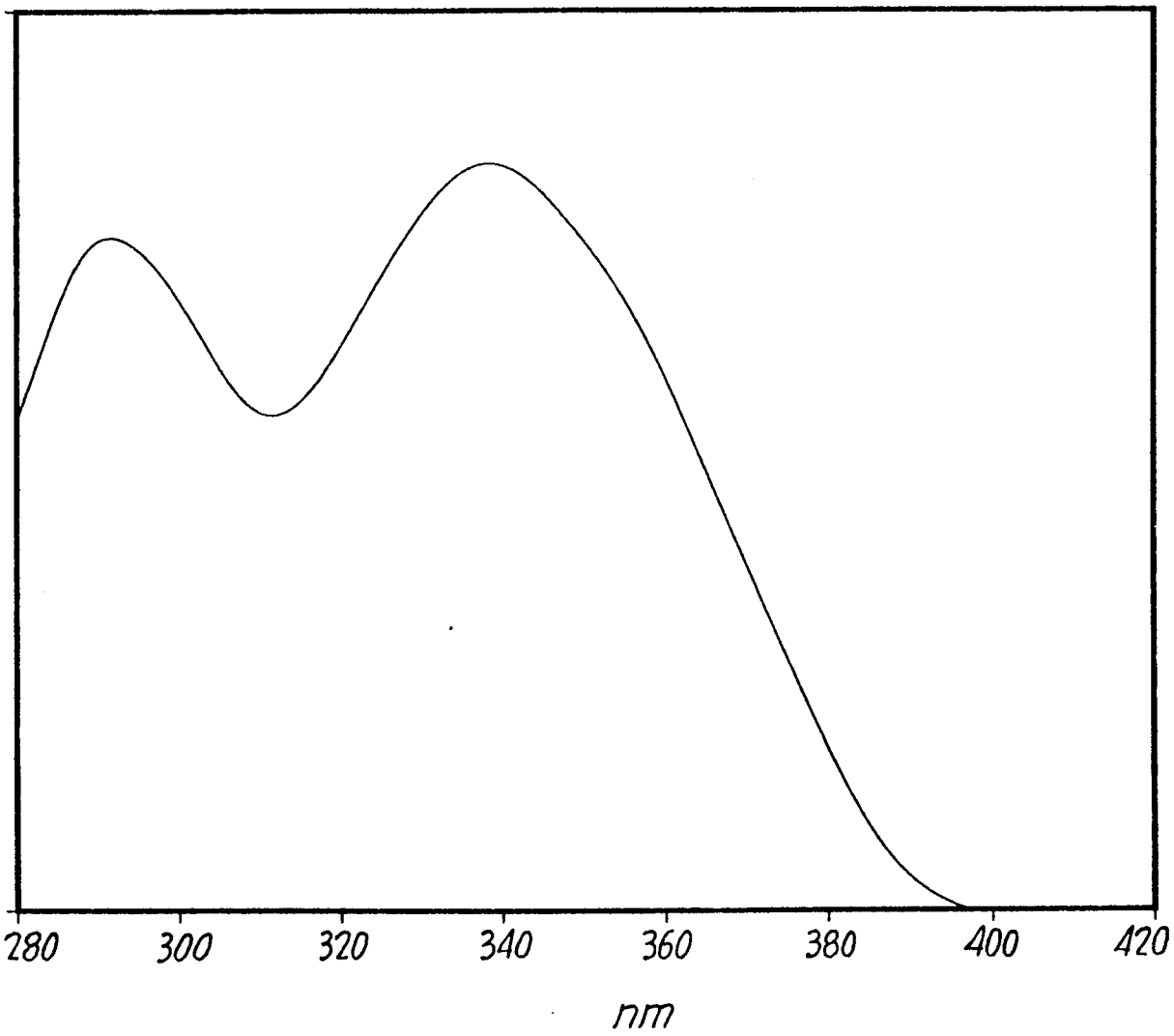
FIG. 2 is an absorption spectra for charged transport compounds A6 from page 7, supra.
Figure 3:
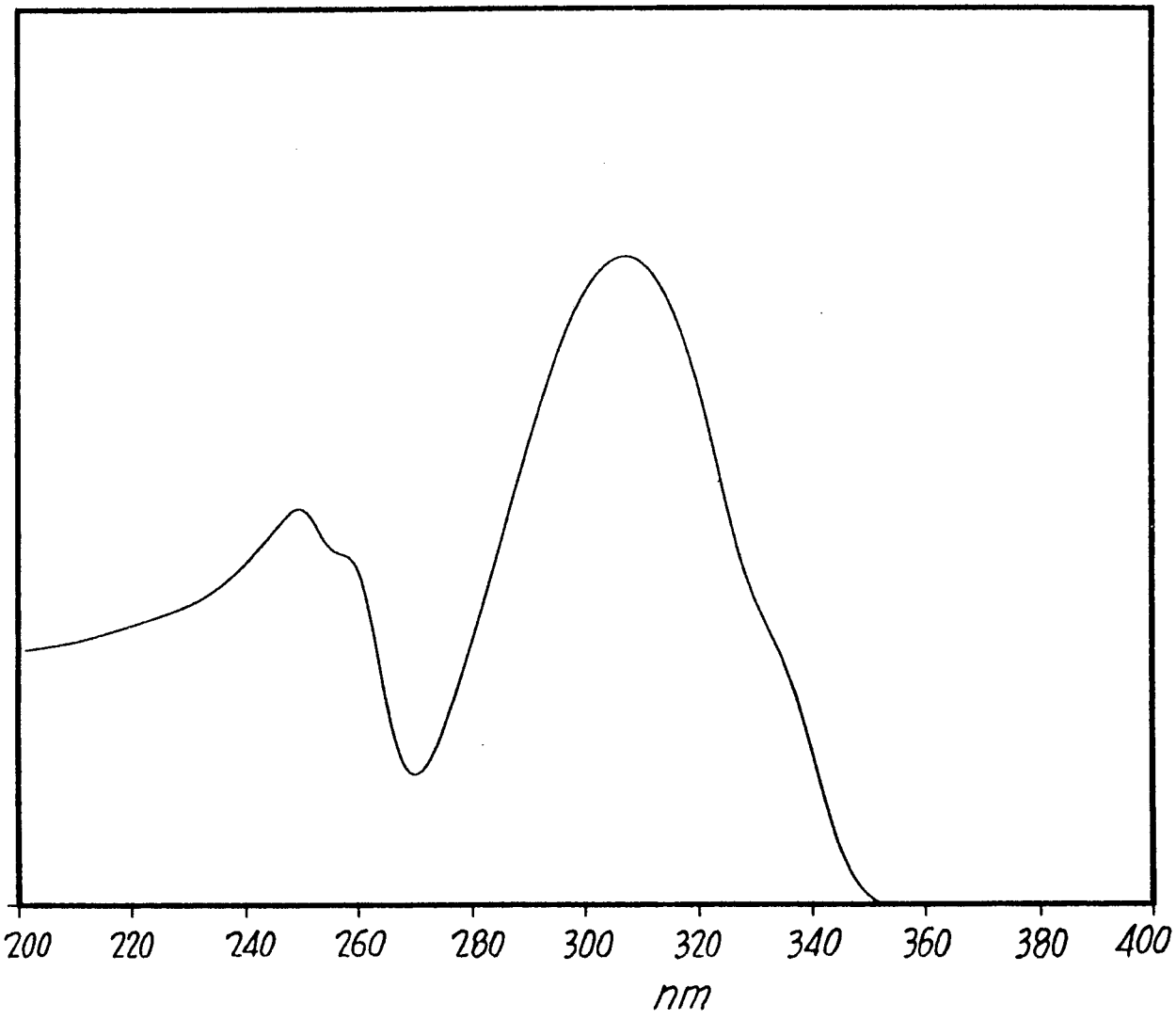
FIG. 3 is an absorption spectra for charged transport compounds A7 from page 7, supra.

More specifically, in the drawing, the minimal visible light absorption of the n-CTM compounds of the present invention is illustrated by the absorption spectra for charge transport compounds A1, A6 and A7 in chloroform solution which spectra are shown in FIGS. 1, 2 and 3 respectively; wavelenght in nm being plotted in the abscissa and relative absorbance (R.A.) being plotted in the ordinate.

Preparations of compounds listed in the above Table I are given below for illustrative purposes.

Preparation of 2,2-dimethylindan-1,3-dione (AO):

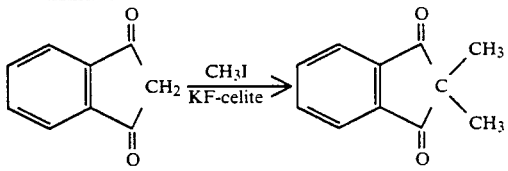

20 g (0.137 moles) of indan-1,3-dione was added to 200 ml of acetonitrile. 26 ml (0.41 moles) of methyl iodide and 8 g of a KF-celite (1:1) mixture were then added to this mixture and the resulting red mixture stirred for 18 hours at 60° C. under a nitrogen atmosphere. After cooling, the precipitate was filtered off and washed with acetonitrile. The filtrate was then evaporated to dryness and the residue chromatographically purified using a silica column with hexane/ether (6:4) as the eluent. 10.5 g of 2,2-dimethyl-indan-1,3-dione was obtained with a melting point of 107° C.

Preparation of compound A7:

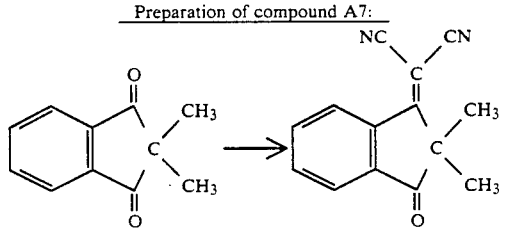

AO A7

A mixture of 4 g of A0, 7 g malononitrile and 6.2 g sodium acetate in 40 ml ethanol was refluxed for 8 hours. After cooling, the precipitate was filtered off and chromatographically purified. 3.1 g of A7 was obtained with a melting point of 179° C.

Preparation of compound A1:

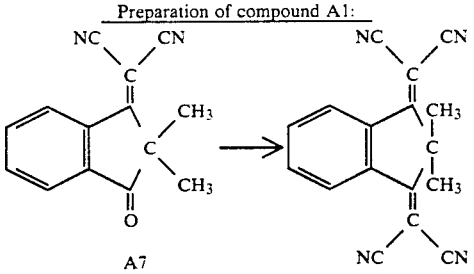

A7 A1

2 g of A7 (9 mmoles), 60 ml methylene chloride and 2 g (30 mmoles) malononitrile were added to one another under an argon atmosphere. 10.4 g (54 mmoles) of titanium tetrachloride were then added followed with cooling by 16.6 g (210 mmoles) of pyridine over a period of 15 minutes. The reaction mixture was then stirred at room temperature for 8 hours, then poured into 1N hydrochloric acid and the organic phase separated. The organic phase was then washed free of acid, dried and evaporated to dryness. The residue was then purified by column chromatography yielding 1.3 g of A1 with a melting point of 229° C.

Preparation of compound A6:

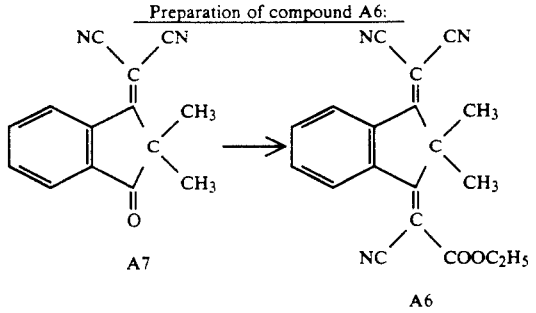

7.6 g of A7 and 9.6 g ethyl α-cyanoacetate were dissolved in a mixture of 240 ml methylene chloride and 68 g pyridine under an argon atmosphere. 38.7 g of titanium tetrachloride were then added over a period of 30 minutes and the reaction mixture stirred for 24 hours at room temperature, after which it was poured into 500 ml of 1N hydrochloric acid. The organic phase was separated off, washed free of acid and evaporated to dryness. The residue was then purified using a silica column with methylene chloride/hexane (7:3) as the eluent and recrystallized from a 1:1 mixture of methylene chloride and hexane to yield 7.3 g of A6 with a melting point of 140° C.

Preparation of compound A3:

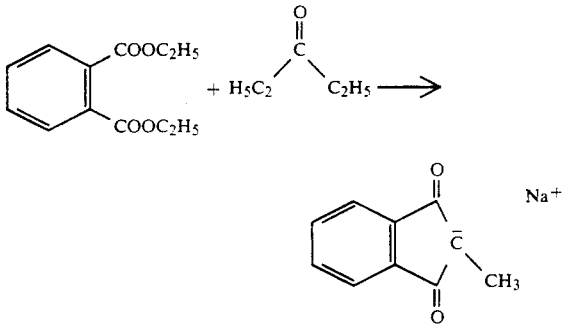

After heating to 35° C. a suspension of 62.4 g (1.3 moles) 50% NaH in mineral oil with 208.8 ml (1 mole) diethylphthalate in 1300 ml dimethyl acetamide was heated to 35° C. 140 ml 3-pentanone was added dropwise over a period of 60 minutes in such a way that the suspension temperature was kept below 40° C. The suspension was stirred for a further 2 hours at 35° C. before cooling to room temperature.

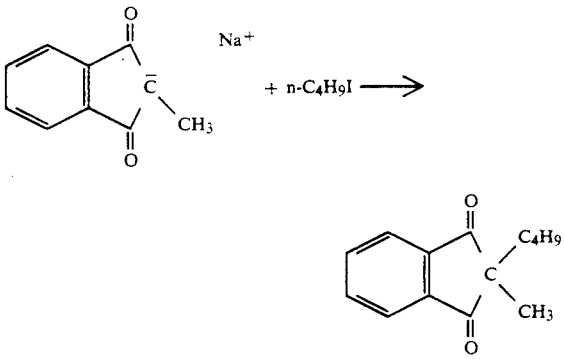

116 ml (1 mole) butyl iodide was then added and the mixture allowed to stand overnight before pouring it into distilled water. After adding 50 ml of 10N NaOH, the mixture was extracted with methylene chloride. After evaporating off the methylene chloride 164 g of a red oil was obtained, which upon vacuum distillation (boiling point 160°-162° C. at 10 mm Hg) yielded 63 g of 2-butyl-2-methyl-indan-1,3-dione.

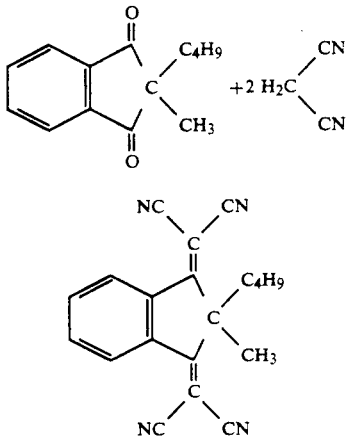

A solution of 27 g (0.125 moles) 2-butyl-2-methyl-indan-1,3-dione, 19.8 g (0.3 moles) malononitrile and 32.3 ml pyridine in 200 ml methylene chloride was prepared under an argon atmosphere. 43.9 ml titanium tetrachloride were then added slowly to the mixture, the mixture refluxed for 6 hours, 8.1 ml pyridine and 11 ml titanium tetrachloride added and the mixture refluxed for a further 6 hours. The mixture was then poured into distilled water and extracted with methylene chloride. After evaporating the extract to dryness, the residue was stirred with methanol and the undissolved residue purified by column chromatography yielding 14.6 g of A3 with a melting point of 175° C.

Preparation of A8:

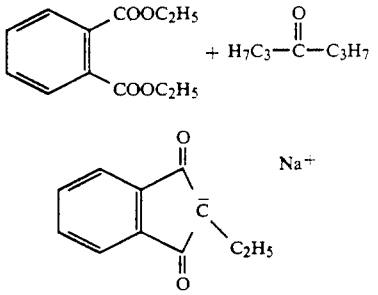

After adding 70.2 g (1.3 moles) sodium methoxide to a solution of 222 g (1 mole) diethyl phthalate in 600 ml dimethyl acetamide, the solution was heated to 45°-50° C. and 186 ml (1.3 moles) 4-heptanone added slowly over a period of 4 hours.

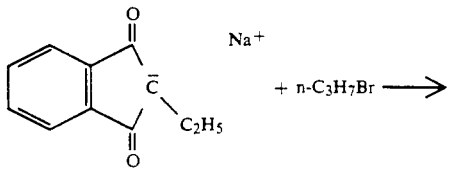

-continued

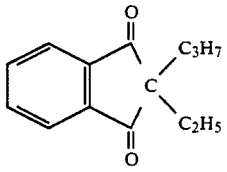

123 g (1 mole) of propyl bromide were then added dropwise to the solution.

The resulting solution was stirred at 50° C. for 6 hours and then poured into distilled water. After extraction with methylene chloride, the solvent was evaporated and the residual oil vacuum distilled (boiling point 160°-165° C. at 11 mm Hg) to yield 65 g of 2-ethyl-2-propyl-indan-1,3-dione.

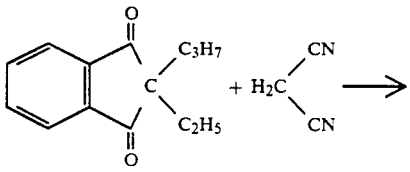

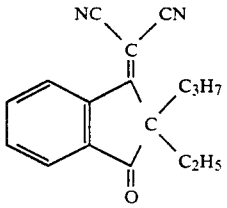

A solution of 10.8 g (0.05 moles) of 2-ethyl-2-propyl-indan-1,3-dione, 9.8 g (0.15 moles) of malononitrile, 16.2 ml (0.2 moles) of pyridine in 200 ml of methylene chloride was prepared under an argon atmosphere. A solution of 22 ml (0.2 moles) of titanium tetrachloride was added to this solution over a period of 30 minutes followed by 5 hours refluxing, cooling and pouring onto ice. After extraction with methylene chloride, the extract was washed free of acid, dried and evaporated to dryness. The residue was purified by column chromatography yielding 8.6 g of A8 with a melting point of 69° C.

Preparation of compound A24

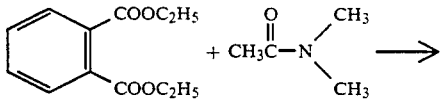

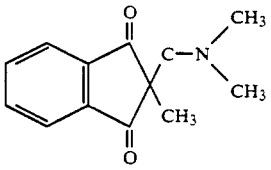

I 41.8 mg of diethyl phthalate were added to a suspension of 12.4 g of NaH (50% in mineral oil) in 250 ml of dimethyl acetamide. After stirring for 24 hours at room temperature, 25.1 ml of methyl iodide were added and the resulting mixture heated at 50° C. for 24 hours. The mixture was then poured into distilled water and the precipitate filtered off and recrystallized from ethyl acetate. A yield of 11.4 g of I was obtained with a melting point of 173° C.

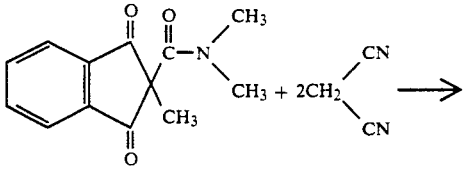

I

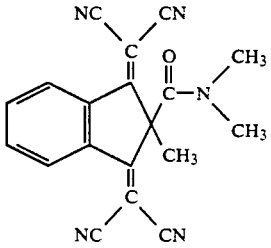

A24

A solution of 6.9 g of I and 5.9 g of malononitrile in 100 ml of methylene chloride were added to a solution of 33 ml of $TiCl_4$ in 150 ml of methylene chloride. 24 ml of pyridine were then added and the reaction mixture stirred for 16 hours at room temperature before pouring it into distilled water and extracting it with methylene chloride. After evaporating off the solvent from the extract, the product was chromatographically purified yielding 3.2 g of A24 with a melting point >260° C.

Preparation of compound A27

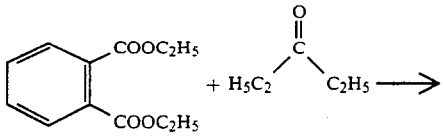

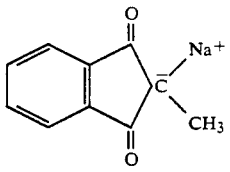

II 112 g of 3-pentanone was added to a suspension of 70.2 g of sodium methoxide (1.3 moles) and 222 g of diethylphthalate in 500 ml of dimethyl acetamide and the mixture then heated for 4 hours at 50° C.

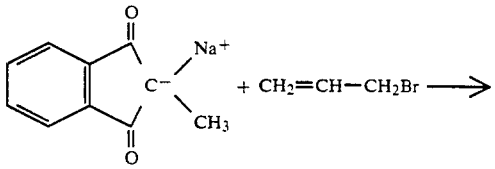

-continued

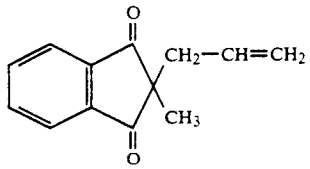

157 g of allylbromide were then added to the reaction mixture, the mixture stirred for 1 hour at 50° C. and then poured into distilled water. The desired product was then extracted with methylene chloride, the extract dried and the soluent evaporated off yielding a light yellow oil (201 g) with a purity according to gas chromatography of 72%.

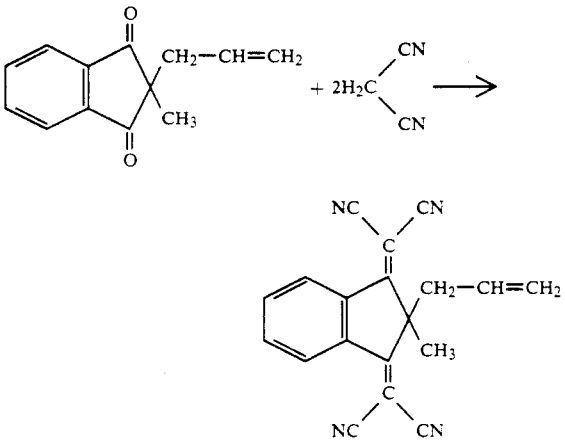

A27

26.2 g of malononitrile and 50 g of 2-allyl-2-methyl-indan-1,3-dione with a purity of 72% were added to a solution of 118.5 ml of $TiCl_4$ in 600 ml of methylene chloride. 103 ml of pyridine were then added dropwise to the resulting solution over a period of 30 minutes keeping the solution temperature in the range 35° to 40° C. The reaction mixture was then refluxed 1 hour, cooled 15° C. and 150 ml of distilled water added before pouring it into 500 ml of ice water. After separating off the methylene chloride layer and washing it with sodium carbonate solution until it was acid free, methylene chloride was evaporated off yielding a solid product. Stirring in ethanol and two recrystallizations from methoxyisopropanol yielded 35 g of A27 with a melting point of 116° C.

Preparation of compound A35

4-methyl dimethyl phthalate was prepared according to the procedure described by J. Wolinsky and R. B. Login in J. Org. Chem. 35, 3205-7 (1970).

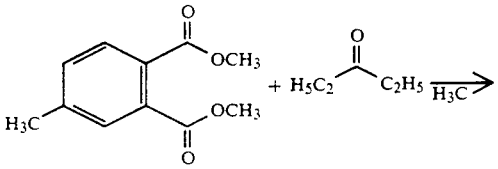

-continued

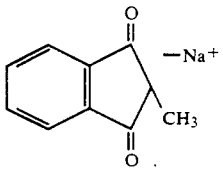

III

III was prepared from 4-methyl dimethylphthalate using the procedure used for the preparation of II in the synthesis of A27.

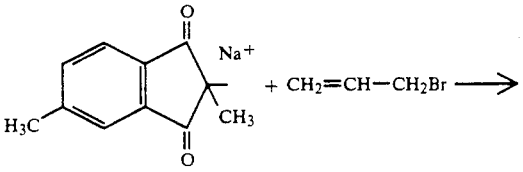

III

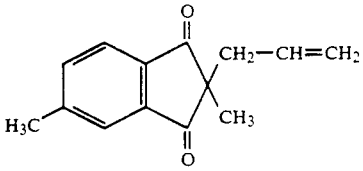

IV was prepared from III using the procedure used for the preparation of 2-allyl-2-indan-1,3-dione in the synthesis of A27.

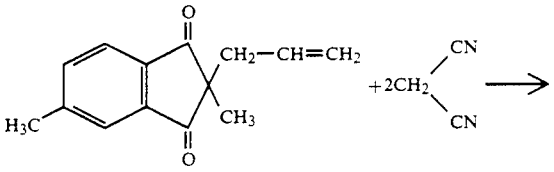

IV

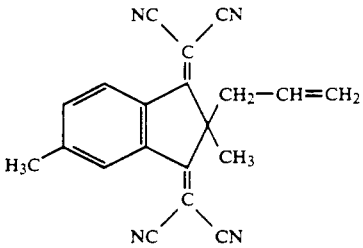

A35

A35 was prepared from IV using the procedure used for the preparation of A27 from 2-allyl-2-methyl-indan-1,3-dione. The product had a melting point of 163° C.

According to one embodiment an electrophotographic recording material of the present invention comprises an electrically conductive support having thereon a photosensitive charge generating layer in contiguous relationship with a charge transporting layer, characterized in that said charge transporting layer contains one or more n-CTM compounds corresponding to a general formula (A), (B) or (C) as defined above.

The content of the n-CTM compound used according to the present invention in a negative charge transport layer is preferably in the range of 20 to 70% by weight with respect to the total weight of said layer. The thickness of the charge transporting layer is preferably in the range of 5 to 50 μm, and more preferably in the range of 5 to 30 μm.

According to another embodiment an electrophotographic recording material according to the present invention comprises an electrically conductive support having thereon a positively chargeable photoconductive recording layer which contains in an electrically insulating organic polymeric binder at least one p-type pigment substance and at least one n-type photoconductive charge transport substance, wherein (i) at least one of the n-type charge transport substances is a compound corresponding to a general formula (A), (B) or (C) as defined above, (ii) said layer has a thickness in the range of 4 to 40 μm and comprises 5 to 40% by weight of said p-type pigment substance and 0.0001 to 15% by weight of at least one of said n-type charge transport substance(s) that is (are) molecularly distributed in said electrically insulating organic polymeric binder material that has a volume resistivity of at least $10^{14}$ Ohm-m, and wherein (iv) said recording layer in electrostatically charged state requires for 10% and 90% discharge respectively exposures to conductivity increasing electromagnetic radiation that differ by a factor 4.5 or less.

The p-type pigment may be inorganic or organic and may have any colour including white. It is a finely divided substance dispersible in the organic polymeric binder of said photoconductive recording layers.

Optionally the support of said photoconductive recording layer is pre-coated with an adhesive and/or a blocking layer (rectifier layer) reducing or preventing charge injection from the conductive support into the photoconductive recording layer, and optionally the photoconductive recording layer is overcoated with an outermost protective layer, more details about said layers being given furtheron.

In accordance with a preferred mode of said last mentioned embodiment said photoconductive recording layer has a thickness in the range of 5 to 35 μm and contains 6 to 30% by weight of said p-type pigment material(s) and 0.001 to 12% by weight of said n-type transport substance(s).

By the term "n-type" material is understood a material having n-type conductance, which means that the photocurrent ($I_n$) generated in said material when in contact with an illuminated transparent electrode having negative electric polarity is larger than the photocurrent ($I_p$) generated when in contact with a positive illuminated electrode ($I_n/I_p > 1$).

By the term "p-type" material is understood a material having p-type conductance, which means that the photocurrent ($I_n$) generated in said material when in contact with an illuminated transparent electrode having positive electric polarity is larger than the photocurrent ($I_p$) generated when in contact with a negative illuminated electrode ($I_p/I_n > 1$).

Preferred examples of p-type pigments dispersible in the binder of a negatively chargeable recording layer of the electrophotographic recording material according to said last mentioned preferred embodiment are organic pigments from one of the following classes:

a) naphthalo- and phthalo-cyanines such as metal free, metal, metal-oxy, metal-halo and siloxy-silicon metal naphthalo- and phthalocyanines e.g. χ-metal-free phthalocyanines as described e.g. in U.S. Pat. No. 3,594,163; U.S. Pat. No. 3,816,118; U.S. Pat. No. 3,894,868 and CA-P 899,870; siloxy-silicon naphthalocyanines as described e.g. in EP-A 243,205: vanadyl phthalocyanines as described e.g. in U.S. Pat. No. 4,771,133; bromoindium phthalocyanines as described e.g. in U.S. Pat. Nos. 4,666,802 and 4,727,139; τ and μ-metal-free phthalocyanines as described e.g. in U.S. Pat. No. 4,749,637 and metal, metal-oxy and metal-halo naphthalocyanines as described e.g. in EP 288,876.

b) quinoxaline pigments e.g.

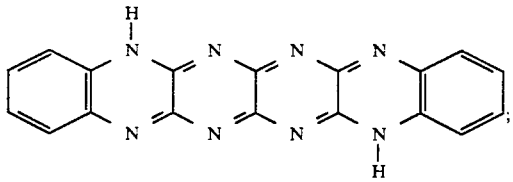

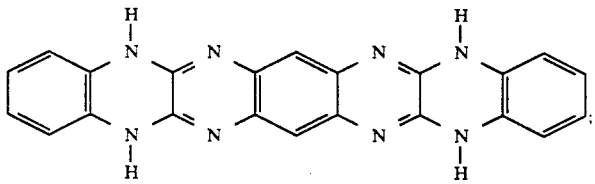

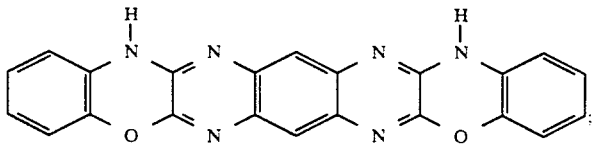

-continued

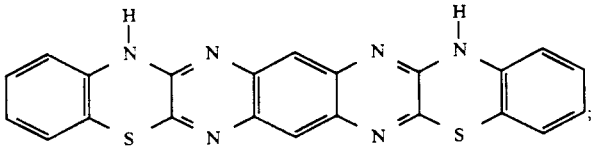

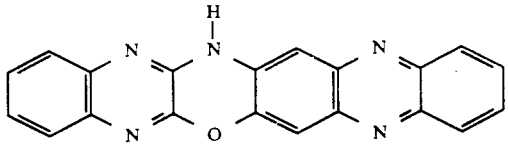

c) dioxazine pigments with the general formula:

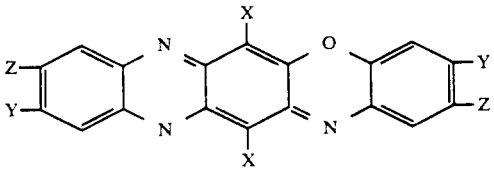

wherein X is Cl, $CONHC_6H_5$, $NHOCCH_3$, $NHC_6H_5$, $CONH_2$;

Y is p-chlorophenyl, $NHC_6H_5$, $NHOCCH_3$, $NH_2$, $OC_6H_5$, H;

Z is H, alkoxy, e.g. $OC_2H_5$ or O-iso.$C_3H_7$, Cl, $NO_2$ or $COC_6H_5$;

or Z and Y together form a substituted or unsubstituted heterocyclic ring, e.g.;

Carbazole Dioxazine Violet (CI Pigment Violet 23, CI 51319) with the formula:

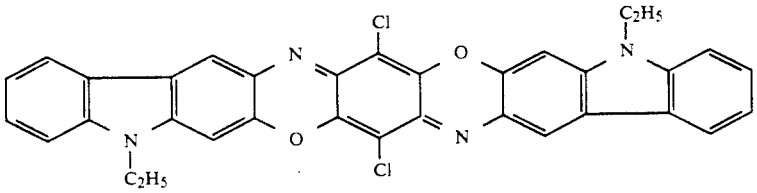

d) p-type polyazo pigments including bisazo-, trisazo- and tetrakisazo-pigments, e.g. the polyazo compounds described in published European Patent Application 0,350,984.

For the production of a preferred recording material according to the present invention at least one of the n-CTM compounds according to one of the general formulae (A), (B) or (C) is applied in combination with a resin binder to form a charge transporting layer adhering directly to a charge generating layer on an electrically conductive support. Through the resin binder the charge transporting layer obtains sufficient mechanical strength and obtains or retains sufficient capacity to hold an electrostatic charge for copying purposes. Preferably the specific resistivity of the charge transporting layer is not lower than $10^9$ ohm.cm. The resin binders are selected with the aim of obtaining optimal mechanical strength, adherence to the charge generating layer and favourable electrical properties.

Suitable electronically inactive binder resins for use in the charge transporting layer are e.g. cellulose esters, acrylate and methacrylate resins, e.g. cyanoacrylate resin, polyvinyl chloride, copolymers of vinyl chloride, e.g. copolyvinyl/acetate and copolyvinyl/maleic anhydride, polyester resins, e.g. copolyesters of isophthalic acid and terephthalic acid with glycol, aromatic polycarbonate resins and polyester carbonate resins, silicone resins, polystyrene, copolymers of styrene and maleic anhydride and copolymers of N-vinylcarbazole having a N-vinylcarbazole content of at least 40% by weight.

A polyester resin particularly suited for use in combination with aromatic polycarbonate binders is DYNAPOL L 206 (registered trade mark of Dynamit Nobel for a copolyester of terephthalic acid and isophthalic acid with ethylene glycol and neopentyl glycol, the molar ratio of tere- to isophthalic acid being 3/2). Said polyester resin improves the adherence to aluminium that may form a conductive coating on the support of the recording material.

Suitable aromatic polycarbonates can be prepared by methods such as those described by D. Freitag, U. Grigo, P. R. Müller and W. Nouvertné in the Encyclopedia of Polymer Science and Engineering, 2nd ed., Vol. II, pages 648–718, (1988) published by Wiley and Sons Inc., and have one or more repeating units within the scope of the following general formula (I):

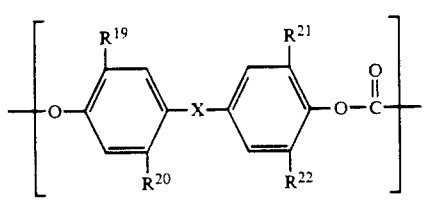

(I)

wherein:

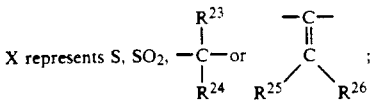

X represents S, $SO_2$, $-\overset{R^{23}}{\underset{R^{24}}{C}}-$ or $-\overset{\|}{C}-\underset{R^{25}\ \ R^{26}}{C}$ ;

$R^{19}$, $R^{20}$, $R^{21}$, $R^{22}$, $R^{25}$ and $R^{26}$ each represents (same or different) hydrogen, halogen, an alkyl group or an aryl group, and $R^{23}$ and $R^{24}$ each represent (same or different) hydrogen, an alkyl group, an aryl group or together represent the necessary atoms to close a cycloaliphatic ring, e.g. cyclohexane ring.

Aromatic polycarbonates having a molecular weight in the range of 10,000 to 200,000 are preferred. Suitable polycarbonates having such a high molecular weight are sold under the registered trade mark MAKROLON of Farbenfabriken Bayer AG, W-Germany.

MAKROLON CD 2000 (registered trade mark) is a bisphenol A polycarbonate with molecular weight in the range of 12,000 to 25,000 wherein $R^{19}=R^{20}=R^{21}=R^{22}=H$, X is

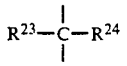

with $R^{23}=R^{24}=CH_3$.

MAKROLON 5700 (registered trade mark) is a bisphenol A polycarbonate with molecular weight in the range of 50,000 to 120,000 wherein $R^{19}=R^{20}=R_{21}=R^{22}=H$, X is

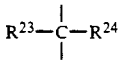

with $R^{23}=R^{24}=CH_3$.

Preferred binders for the negative charge transporting charge transporting layers of the present invention are homo- or co-polycarbonates with the general formula:

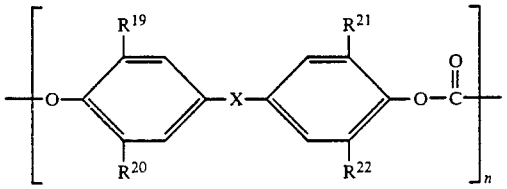

wherein: X, $R^{19}$, $R^{20}$, $R^{21}$ and $R^{22}$ have the same meaning as described in general formula (II) above. Specific polycarbonates useful as CTL-binders in the present invention are P1 to P7:

P1:

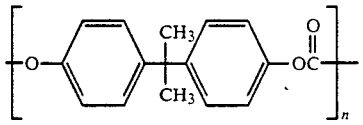

P2:

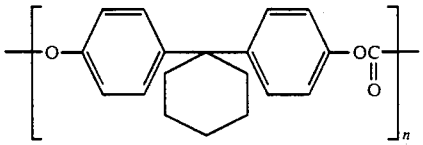

P3:

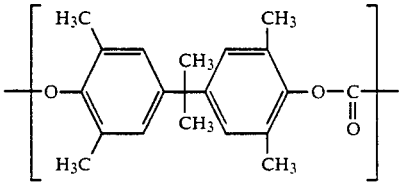

P4:

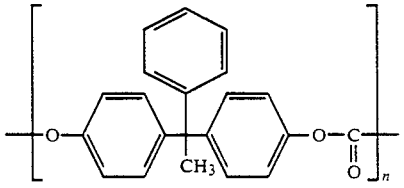

P5:

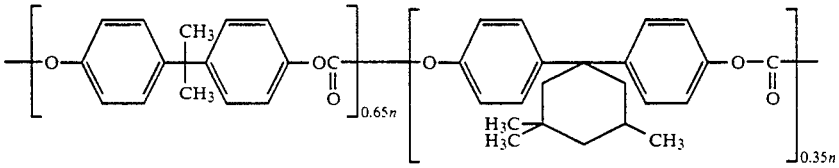

P6:

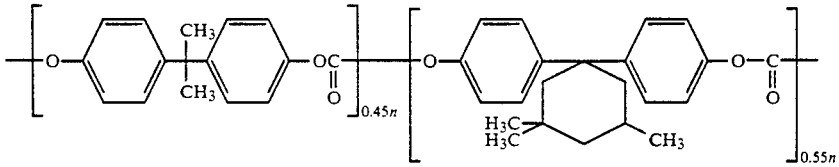

P7:

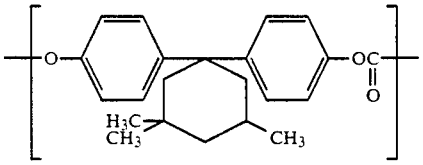

Further useful binder resins are silicone resins, polystyrene and copolymers of styrene and maleic anhydride and copolymers of butadiene and styrene.

An example of an electronically active resin binder is poly-N-vinylcarbazole or copolymers of N-vinylcarbazole having a N-vinylcarbazole content of at least 40% by weight.

The ratio wherein the charge-transporting compound and the resin binder are mixed can vary. However, relatively specific limits are imposed, e.g. to avoid crystallization.

The presence of one or more spectral sensitizing agents can have an advantageous effect on the charge transport. In that connection reference is made to the methine dyes and xanthene dyes described in U.S. Pat. No. 3,832,171. Preferably these dyes are used in an amount not substantially reducing the transparency in the visible light region (420–750 nm) of the charge transporting layer so that the charge generating layer still can receive a substantial amount of the exposure light when exposed through the charge transporting layer.

The charge transporting layer may contain compounds substituted with electron-donor groups forming an intermolecular charge transfer complex, i.e. donor-acceptor complex wherein the hydrazone compound represents an electron donating compound. Useful compounds having electron-donating groups are hydrazones such as 4-N,N-diethylamino-benzaldehyde-1,1-diphenylhydrazone (DEH), amines such as tris(p-tolylamine) (TTA) and N,N'-diphenyl-N,N'-bis(3-methylphenyl)-[1,1-biphenyl]-4,4'-diamine (TPD) etc. The optimum concentration range of said derivatives is such that the molar donor/acceptor ratio is 10:1 to 1,000:1 and vice versa.

Compounds acting as stabilising agents against deterioration by ultra-violet radiation, so-called UV-stabilizers, may also be incorporated in said charge transport layer. Examples of UV-stabilizers are benztriazoles.

For controlling the viscosity of the coating compositions and controlling their optical clarity silicone oils may be added to the charge transport layer.

The charge transport layer used in the recording material according to the present invention possesses the property of offering a high charge transport capacity coupled with a low dark discharge. While with the common single layer photoconductive systems an increase in photosensitivity is coupled with an increase in the dark current and fatigue such is not the case in the double layer arrangement wherein the functions of charge generation and charge transport are separated and a photosensitive charge generating layer is arranged in contiguous relationship to a charge transporting layer.

As charge generating compounds for use in a recording material according to the present invention any of the organic pigment dyes belonging to one of the following classes and able to transfer electrons to electron transporting materials may be used:

a) perylamides, e.g. C.I. 71 130 (C.I.=Colour Index) described in DBP 2,237,539,
b) polynuclear quinones, e.g. anthanthrones such as C.I. 59 300 described in DBP 2,237,678,
c) quinacridones, e.g. C.I. 46 500 described in DBP 2,237,679,
d) naphthalene 1,4,5,8-tetracarboxylic acid derived pigments including the perinones, e.g. Orange GR, C.I. 71 105 described in DBP 2,239,923,
e) phthalocyanines and naphthalocyanines, e.g. $H_2$-phthalocyanine in X-crystal form (X-$H_2$Pc), metal phthalocyanines, e.g. CuPc C.I. 74 160 described in DBP 2,239,924, indium phthalocyanine described in U.S. Pat. No. 4,713,312, and silicon naphthalocyanines having siloxy groups bonded to the central silicon as described in EP-A 0243205.
f) indigo- and thioindigo dyes, e.g. Pigment Red 88, C.I. 73 312 described in DBP 2,237,680,
g) benzothioxanthene-derivatives as described e.g. in DAS 2,355,075,
h) perylene 3,4,9,10-tetracarboxylic acid derived pigments including condensation products with o-diamines as described e.g. in DAS 2,314,051,
i) polyazo-pigments including bisazo-, trisazo- and tetrakisazo-pigments, e.g. Chlordiane Blue C.I. 21 180 described in DAS 2,635,887, and bisazopigments described in DOS 2,919,791, DOS 3,026,653 and DOS 3,032,117,
j) squarilium dyes as described e.g. in DAS 2,401,220,
k) polymethine dyes.
l) dyes containing quinazoline groups, e.g. as described in GB-P 1,416,602 according to the following general formula:

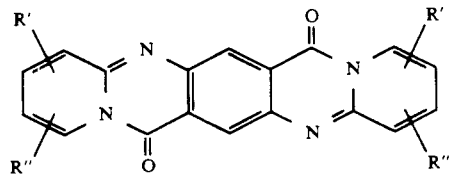

Inorganic substances suited for photogenerating negative charges in a recording material according to the present invention are e.g. amorphous selenium and selenium alloys e.g. selenium-tellurium, selenium-tellurium-arsenic and selenium-arsenic and inorganic photoconductive crystalline compounds such as cadmium sulphoselenide, cadmiumselenide, cadmium sulphide and mixtures thereof as disclosed in U.S. Pat. No. 4,140,529.

Said photoconductive substances functioning as charge generating compounds may be applied to a support with or without a binding agent. For example, they are coated by vacuum-deposition without binder as described e.g. in U.S. Pat. Nos. 3,972,717 and 3,973,959. When dissolvable in an organic solvent the photoconductive substances may likewise be coated using a wet coating technique known in the art whereupon the solvent is evaporated to form a solid layer. When used in combination with a binding agent or agents at least the binding agent(s) should be soluble in the coating solution and the charge generating compound dissolved or dispersed therein. The binding agent(s) may be the same as the one(s) used in the charge transport layer which normally provides best adhering contact. In some cases it may be advantageous to use in one or both of said layers a plasticizing agent, e.g. halogenated paraffin. polybiphenyl chloride, dimethylnaphthalene or dibutyl phthalate.

The thickness of the charge generating layer is preferably not more than 10 μm, more preferably not more than 5 μm.

In the recording materials of the present invention an adhesive layer or barrier layer may be present between the charge generating layer and the support or the charge transport layer and the support. Useful for that purpose are e.g. a polyamide layer, nitrocellulose layer, hydrolysed silane layer, or aluminium oxide layer acting as blocking layer preventing positive or negative charge injection from the support side. The thickness of said barrier layer is preferably not more than 1 micron.

The conductive support may be made of any suitable conductive material. Typical conductors include aluminum, steel, brass and paper and resin materials incorporating or coated with conductivity enhancing substances, e.g. vacuum-deposited metal, dispersed carbon black, graphite and conductive monomeric salts or a conductive polymer, e.g. a polymer containing quaternized nitrogen atoms as in Calgon Conductive polymer 261 (trade mark of Calgon Corporation, Inc., Pittsburgh, Pa., U.S.A.) described in U.S. Pat. No. 3,832,171.

The support may be in the form of a foil, web or be part of a drum. According to a particular embodiment the n-CTM compounds within the scope of one of the above general formulae (A), (B) or (C) having negative charge transport capacity i.e. being electron transporting materials, are used in the production up of electroluminescent (EL) devices as described e.g. in the periodical J. Appl. Phys. Lett. 57 (6). 6 Aug. 1990, p. 531-533. Such device consists basically of an emitter layer (EML) and carrier transport layers. In a three-layer cell structure an emitter layer is sandwiched between hole ((HTL) and electron (ETL) transport layers, the hole and electron transport layer each being in contact with an electrode. Particulars about the composition and thickness of the emitter layer, hole transport layer, suitable electron transport layers and electrodes are described in the above mentioned periodical. The present n-CTM compounds are suited for use in an electron transport layer (ETL) of an electroluminescent device.

An electrophotographic recording process according to the present invention comprises the steps of:

(1) overall electrostatically charging, e.g. with corona-device, the photoconductive layer containing at least one of the above defined n-CTM compounds according to the general formula (A), (B) or (C);

(2) image-wise photo-exposing said layer thereby obtaining a latent electrostatic image, that may be toner-developed.

When applying a bilayer-system electrophotographic recording material including on an electrically conductive support a photosensitive charge generating layer in contiguous relationship with a charge transporting layer that contains one or more n-CTM compounds corresponding to the general formula (A), (B) or (C) as defined above, the photo-exposure of the charge generating layer proceeds preferably through the charge transporting layer but may be direct if the charge generating layer is uppermost or may proceed likewise through the conductive support if the latter is transparent enough to the exposure light.

The development of the latent electrostatic image commonly occurs preferably with finely divided electrostatically attractable material, called toner particles that are attracted by coulomb force to the electrostatic charge pattern. The toner development is a dry or liquid toner development known to those skilled in the art.

In positive-positive development toner particles deposit on those areas of the charge carrying surface which are in positive-positive relation to the original image. In reversal development, toner particles migrate and deposit on the recording surface areas which are in negative-positive image value relation to the original. In the latter case the areas discharged by photo-exposure obtain by induction through a properly biased developing electrode a charge of opposite charge sign with respect to the charge sign of the toner particles so that the toner becomes deposited in the photo-exposed areas that were discharged in the imagewise exposure (ref.: R. M. Schaffert "Electrophotography"—The Focal Press—London, New York, enlarged and revised edition 1975, p. 50-51 and T. P. Maclean "Electronic Imaging" Academic Press—London, 1979, p. 231).

According to a particular embodiment electrostatic charging, e.g. by corona, and the imagewise photo-exposure proceed simultaneously.

Residual charge after toner development may be dissipated before starting a next copying cycle by overall exposure and/or alternating current corona treatment.

Recording materials according to the present invention depending on the spectral sensitivity of the charge generating layer may be used in combination with all kinds of photon-radiation, e.g. light of the visible spectrum, infra-red light, near ultra-violet light and likewise X-rays when electron-positive hole pairs can be formed by said radiation in the charge generating layer. Thus, they can be used in combination with incandescent lamps, fluorescent lamps, laser light sources or light emitting diodes by proper choice of the spectral sensitivity of the charge generating substance or mixtures thereof.

The toner image obtained may be fixed onto the recording material or may be transferred to a receptor material to form thereon after fixing the final visible image.

A recording material according to the present invention showing a particularly low fatigue effect can be used in recording apparatus operating with rapidly following copying cycles including the sequential steps of overall charging, imagewise exposing, toner development and toner transfer to a receptor element.

The following examples further illustrate the present invention. All parts, ratios and percentages are by weight unless otherwise stated.

The evaluations of electrophotographic properties determined on the recording materials of the following examples relate to the performance of the recording materials in an electrophotographic process with a reusable photoreceptor. The measurements of the performance characteristics were carried out by using a sensitometric measurement in which the discharge was obtained for 8 different exposures including zero exposure. The photoconductive recording sheet material was mounted with its conductive backing on an aluminium drum which was earthed and rotated at a circumferential speed of 5 cm/s. The recording material was sequentially charged with a negative corona at a voltage of −4.3 kV operating with a corona current of about 1 μA per cm of corona wire. Subsequently the recording material was exposed (simulating image-wise exposure) with a light dose of monochromatic light obtained from a monochromator positioned at the circumference of the drum at an angle of 45° with respect to the corona source. The photo-exposure lasted 400 ms. Thereupon, the exposed recording material passed an electrometer probe positioned at an angle of 180° with respect to the corona source. After effecting an overall post-exposure with a halogen lamp producing 54.000 mJ/m2 positioned at an angle of 270° with respect to the corona source a new copying cycle started. Each measurement relates to 40 copying cycles in which the photoconductor is exposed to the full light source intensity for the first 5 cycles, then sequentially to the light source the light output of which is moderated by grey filters of optical densities 0.5, 1.0, 1.5, 2.0, 2.5, 3.0 and 3.5 each for 5 cycles and finally to zero light intensity for the last 5 cycles.

The electro-optical results quoted in the EXAMPLES hereinafter refer to charging level at zero light intensity (CL) and to discharge at a light intensity corresponding to the light source intensity moderated by a grey filter with an optical density of 1.0 to a residual potential RP except in the case of 780 nm exposure in which the grey filter has an optical density of 1.5.

The % discharge is:

$$\frac{(CL - RP)}{CL} \times 100$$

For a given corona voltage, corona current, separating distance of the corona wires to recording surface and drum circumferential speed the charging level CL is only dependent upon the thickness of the charge transport layer and its specific resistivity. In practice CL expressed in volts should be preferably $\geqq 30$ d, where d is the thickness in μm of the charge transport layer.

The half-wave reduction potential measurements were carried out using a polarograph with rotating (500 rpm) disc platinum electrode and standard saturated calomel electrode at room temperature (20° C.) using a product concentration of $10^{-4}$ mole and an electrolyte (tetrabutylammonium perchlorate) concentration of 0.1 mole in spectroscopic grade acetonitrile. Ferrocene was used as a reference substance having a half-wave oxidation potential of +0.430 V.

All ratios and percentages mentioned in the Examples are by weight.

EXAMPLES 1 to 24

A photoconductor sheet was produced by first doctor blade coating a 100 μm thick polyester film precoated with a vacuum-deposited conductive layer of aluminium with a 1% solution of γ-aminopropyltriethoxy silane in aqueous methanol. After solvent evaporation and curing at 100° C. for 30 minutes, the thus obtained adhesion/blocking layer was doctor blade coated with a dispersion of charge generating pigment to thickness of 0.6 micron.

Said dispersion was prepared by mixing 5 g of the χ-form of purified metal-free phthalocyanine, 5 g of aromatic polycarbonate MAKROLON CD 2000 (registered trade mark) and 132,86 g of dichloromethane for 16 hours in a ball mill. Subsequently 23,81 g of dichloromethane was added to the dispersion to produce the composition and viscosity for coating.

After drying for 15 minutes at 50° C. this layer was coated with a filtered solution of charge transporting material and MAKROLON 5700 (registered trade mark) in dichloromethane at a solids content of 12% by wt. This layer was then dried at 50° C. for 16 hours.

The characteristics of the thus obtained photoconductive recording material were determined with light doses at the wavelengths given in Table III below.

The n-CTM-concentrations in the charge transport layers of Examples 1 to 24 are also given in Table III.

The electro-optical characteristics of the corresponding photosensitive recording layers are summarized in Table III.

The n-CTM-concentrations in the charge transport layers of Examples 1 to 24 are also given in Table III.

The characteristics of the thus obtained photoconductive recording material were determined with light doses at the wavelengths given in Table III below.

TABLE III

| Example No. | Charge transport comp. | Charge transp. comp. conc. % wt | Thick. of CTL μm | Wavelength [nm] | CL [V] | Exposure It [mJ/m²] | RP [V] | % discharge |
|---|---|---|---|---|---|---|---|---|
| 1 | A.1 | 40 | 15.4 | 780 | +759 | 20.7 | +91 | 88.0 |
| 2 | A.2 | 50 | 12.4 | 650 | +541 | 20 | +87 | 83.9 |
| 3 | A.3 | 50 | 13.4 | 780 | +512 | 20 | +106 | 79.3 |
| 4 | A.4 | 50 | 12.4 | 780 | +492 | 20 | +95 | 80.7 |
| 5 | A.5 | 50 | 11.4 | 780 | +484 | 20 | +121 | 75.0 |
| 6 | A.6 | 50 | 11.4 | 650 | +574 | 20 | +256 | 56.4 |
| 7 | A.9 | 50 | 11.4 | 780 | +558 | 20 | +515 | 7.7 |
| 8 | A.11 | 50 | 12.4 | 660 | +494 | 20 | +368 | 25.5 |
| 9 | A.20 | 50 | 13.4 | 780 | +477 | 20 | +382 | 19.9 |
| 10 | A.15 | 45 | 9.4 | 660 | +596 | 20 | +416 | 30.2 |
| 11 | A.23 | 50 | 12.4 | 660 | +659 | 20 | +589 | 10.6 |
| 12 | A.24 | 50 | 11.4 | 660 | +443 | 20 | +402 | 9.3 |
| 13 | A.25 | 45 | 11.4 | 660 | +530 | 20 | +107 | 79.8 |
| 14 | A.25 | 50 | 11.4 | 660 | +519 | 20 | +87 | 83.2 |
| 15 | A.26 | 45 | 12.4 | 660 | +537 | 20 | +118 | 78.0 |
| 16 | A.27 | 60 | 11.4 | 660 | +466 | 20 | +32 | 93.1 |
| 17 | A.28 | 45 | 12.4 | 660 | +561 | 20 | +465 | 17.1 |
| 18 | A.29 | 60 | 14.4 | 660 | +520 | 20 | +80 | 84.6 |
| 19 | A.30 | 30 | 13.4 | 660 | +524 | 20 | +257 | 51.0 |
| 20 | A.31 | 45 | 12.4 | 660 | +524 | 20 | +89 | 83.0 |
| 21 | A.32 | 45 | 12.4 | 660 | +483 | 20 | +79 | 83.6 |
| 22 | A.33 | 45 | 11.4 | 660 | +512 | 20 | +109 | 78.7 |
| 23 | A.34 | 50 | 11.4 | 660 | +504 | 20 | +70 | 86.1 |
| 24 | A.35 | 60 | 10.4 | 660 | +498 | 20 | +40 | 92.0 |

EXAMPLES 25 to 32

The photoconductive recording materials of Examples 25 to 32 were produced as for Examples 1 to 24 except that the adhesion/blocking layer was produced by coating the aluminium-coated polyester film with a 3% solution of γ-aminopropyltriethoxysilane in aqueous methanol instead of a 1% solution, the ω-form of metal-free triazatetrabenzoporphine (already described in unpublished EP-A 89121024.7) was applied at a concentration of 40% in the charge generating layer instead of the χ-form of metal-free phthalocyanine at a concentration of 50% by weight.

The characteristics of the thus obtained photoconductive recording material were determined as described above but with photo-exposure to the light doses and at the wavelengths given in Table IV below.

The charge transport compounds used, their concentration in the charge transport layer, the thickness in μm of the charge transport layer (CTL) and the electro-optical characteristics of the corresponding photoconductive recording materials are summarized in Table IV.

TABLE IV

| Example No. | Charge transport comp. | Charge transp. comp. conc. % wt | Thick. of CTL μm | Wavelength [nm] | CL [V] | Exposure It [mJ/m²] | RP [V] | % discharge |
|---|---|---|---|---|---|---|---|---|
| 25 | A.2 | 50 | 12.4 | 650 | +621 | 20 | +512 | 17.6 |
| 26 | A.3 | 50 | 12.4 | 780 | +506 | 20 | +303 | 40.1 |
| 27 | A.4 | 50 | 12.4 | 780 | +476 | 20 | +192 | 59.7 |
| 28 | A.5 | 50 | 11.4 | 780 | +437 | 20 | +182 | 58.4 |
| 29 | A.6 | 50 | 14.4 | 650 | +518 | 20 | +303 | 41.5 |
| 30 | A.9 | 50 | 11.4 | 780 | +522 | 20 | +495 | 5.2 |
| 31 | A.11 | 50 | 12.4 | 780 | +389 | 20 | +335 | 13.9 |
| 32 | A.21 | 50 | 11.4 | 780 | +478 | 20 | +407 | 14.9 |

EXAMPLES 33 to 37

The photoconductive recording layers of examples 33 to 37 were produced as described for example 13 except that different CTL-binders were used as indicated in Table V and in the cases of examples 36 and 37. A4 was used at the CTM instead of A25. The CTL-layer thicknesses are given in Table V.

The electro-optical characteristics of the thus obtained photoconductive recording materials were determined as described above and the results are summarized in Table V with those for the photoconductive recording material of example 13.

TABLE V

| Example No. | CTL-binder | CTM | $d_{CTL}$ [μm] | $I_{660}t$ = 20 mJ/m² CL [V] | RP [V] | % discharge |
|---|---|---|---|---|---|---|
| 13 | P1* | A25 | 11.4 | +530 | +107 | 79.8 |
| 33 | P2 | A25 | 13.4 | +547 | +118 | 78.4 |
| 34 | P3 | A25 | 16.4 | +395 | +83 | 79.0 |
| 35 | P4 | A25 | 12.4 | +198 | +22 | 88.9 |
| 36 | P5 | A4 | 10.4 | +501 | +99 | 80.2 |
| 37 | P7 | A4 | 13.4 | +530 | +120 | 77.4 |

*MAKROLON 5700 (trade name)

EXAMPLE 38

In the production of the photosensitive recording layer of Example 38 a 100 μm thick polyester film precoated with a vacuum-deposited conductive layer of aluminium was doctor-blade coated with a dispersion of the β-form of copper phthalocyanine (CI Pigment Blue 15:3), charge transport compound A7 and the aromatic polycarbonate MAKROLON CD 2000 (registered trade mark) in dichloromethane.

We claim:

1. A photosensitive recording material which comprises an electrically conductive support having thereon a layer containing a charge transporting compound (n-CTM-compound) capable of accepting and transporting electrons which have been obtained by radiation-activated charge-generation from a charge generating compound (CGM-compound) present in said material, characterized in that said n-CTM-compound corresponds to a following general formula (A), (B) or (C):

(A)

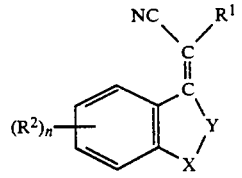

wherein:

$R^1$ represents CN, $COOR^3$ or $COR^3$, $R^2$ represents CN, $COOR^3$, $COR^3$, $SO_2R^4$, F, Cl, alkyl including a substituted alkyl group or an alkoxy group, $R^3$ represents an alkyl group, an aryl group or an aralkyl group including said groups in substituted form, $R^4$ represents F, Cl, an alkyl, an aryl or an aralkyl group including said groups in substituted form;

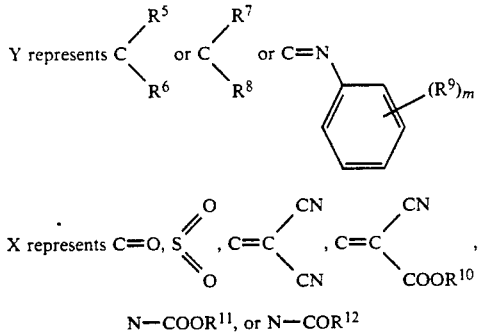

$R^5$ represents an alkyl group including said group in substituted form, $R^6$ represents an alkyl, an alkenyl group, an aryl group, a $—CONR^7R^8$ group or a heterocyclic group including said groups in substituted form, each of $R^7$ and $R^8$ which may be the same or different represents an alkyl or an aryl group including said groups in substituted form or together represent the atoms and bonds necessary to form a carbocyclic or a heterocyclic ring structure including said structure in substituted form;

$R^9$ represents an alkyl group including a substituted alkyl group, an alkoxy group, F, Cl, CN, $NO_2$, a $NR^{13}R^{14}$ group, wherein each of $R^{13}$ and $R^{14}$ represents a $COR^{17}$ or $COOR^{18}$ group, $R^{17}$ and $R^{18}$ having the definition given below, or $R^9$ represents a $COOR^{15}$ or $COR^{16}$ group, wherein $R^{15}$ and $R^{16}$ have the definition given below;

each of $R^{10}$, $R^{11}$, $R^{12}$, $R^{15}$, $R^{16}$, $R^{17}$ and $R^{18}$ which may be the same or different represents an alkyl group, an aryl group or an aralkyl group including said groups in substituted form, n is 0, 1 or 2, and m is 0, 1 or 2;

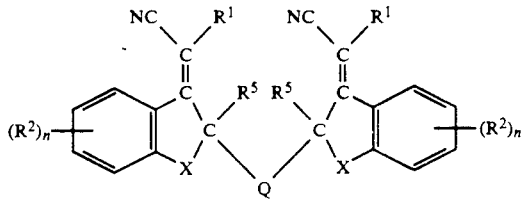

(B)

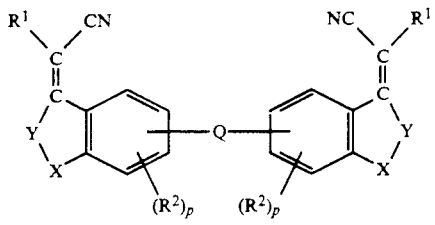

(C)

wherein:

Q represents a divalent organic group, $R^1$, $R^2$, $R^5$, X, Y and n are as defined above, and p is zero or 1.

2. Photosensitive recording material according to claim 1, wherein at least one n-CTM-compound is present in a charge transporting layer that stands in direct contact with a photosensitive charge generating layer.

3. Photosensitive recording material according to claim 2, wherein the thickness of the layer containing said n-CTM compound is in the range of 5 to 50 μm.

4. Photosensitive recording material according to claim 1, wherein said electrically conductive support stands in contact with a positively chargeable photoconductive recording layer which contains in an electrically insulating organic polymeric binder at least one photoconductive p-type pigment substance and at least one n-type charge transport substance, wherein (i) at least one of the n-type charge transport substances is a compound corresponding to a said general formula (A), (B) or (C), (ii) said layer has a thickness in the range of 4 to 40 μm and comprises 5 to 40% by weight of said p-type pigment substance and 0.0001 to 15% by weight of at least one of said n-type charge transport substance(s) that is (are) molecularly distributed in said electrically insulating organic polymeric binder material that has a volume resistivity of at least $10^{14}$ Ohm-m, and wherein (iii) said recording layer in electrostatically charged state requires for 10% and 90% discharge respectively exposures to conductivity increasing electromagnetic radiation that differ by a factor 4.5 or less.

5. Photosensitive recording material according to claim 4, wherein said photoconductive recording layer has a thickness in the range of 5 to 35 μm and contains 6 to 30% by weight of said p-type pigment material(s) and 0.001 to 12% by weight of said n-type transport substance(s).

6. Photosensitive recording material according to claim 4, wherein said p-type pigment substance is an organic pigment selected from one of the following classes:

a) naphthalo- and phthalo-cyanines, b) quinoxaline pigments, c) dioxazine pigments with the general formula:

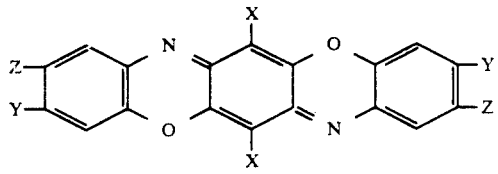

wherein X is Cl, $CONHC_6H_5$, $NHOCCH_3$, $NHC_6H_5$ or $CONH_2$;

Y is hydrogen, p-chlorophenyl, $NHC_6H_5$, $NHOCCH_3$, $NH_2$ or $OC_6H_5$;

Z is hydrogen, alkoxy, Cl, $NO_2$ or $COC_6H_5$;

or Z and Y together form a substituted or unsubstituted heterocyclic ring, or d) p-type polyazo pigments.

7. Photosensitive recording material according to claim 6, wherein the naphthalo- and phthalocyanines are selected from the group consisting of metal free, metal, metal-oxy, metal-halo, and siloxy-silicon metal naphthalo- and phthalocyanines.

8. Photosensitive recording material according to claim 6, wherein the p-type polyazo pigments are selected from the group consisting of bisazo-, trisazo-, and tetrakisazo-pigments.

9. Photosensitive recording material according to claim 1, wherein at least one n-CTM compound is applied in combination with a resin binder to form a charge transporting layer adhering directly to a charge generating layer with one of the two of said layers being itself carried by said electrically conductive support.

10. Photosensitive recording material according to claim 9, wherein the resin binder makes that the specific resistivity of the charge transporting layer is not lower than $10^9$ ohm.cm.

11. Photosensitive recording material according to claim 9, wherein the resin binder is selected from the group consisting of a cellulose ester, acrylate or methacrylate resin, polyvinyl chloride, copolyvinyl/acetate and copolyvinyl/maleic anhydride, polyester resins, aromatic polycarbonate resins or polyester carbonate resins, silicone resins, polystyrene, copolymers of styrene and maleic anhydride and copolymers of N-vinylcarbazole having a N-vinylcarbazole content of at least 40% by weight.

12. Photosensitive recording material according to claim 1, wherein the content of said n-CTM compound in its layer is 20 to 70% by weight with respect to the total weight of said layer.

* * * * *